US005102192A

United States Patent [19]

Barile, Sr.

[11] Patent Number: 5,102,192

[45] Date of Patent: Apr. 7, 1992

[54] DETACHABLE ANCHORING DEVICE FOR A SEAT ASSEMBLY

[75] Inventor: Peter Barile, Sr., Naples, Fla.

[73] Assignee: Shelby Williams Industries, Inc., Morristown, Tenn.

[21] Appl. No.: 554,255

[22] Filed: Jul. 17, 1990

[51] Int. Cl.[5] ..... A47C 15/00

[52] U.S. Cl. ..... 297/257; 297/232; 297/233; 248/501

[58] Field of Search ..... 297/233, 248, 249, 344, 297/349, 257; 248/248, 500, 501, 503.1, 503.1, 681, 510; 403/331, 316; 24/669

[56] References Cited

U.S. PATENT DOCUMENTS 1,049,159 12/1912 Simmel ..... 297/248
3,542,326 11/1970 Reapsummer ..... 297/344
4,046,419 9/1977 Schmitt ..... 297/344

*Primary Examiner*—Kenneth J. Dorner
*Assistant Examiner*—Milton Nelson, Jr.
*Attorney, Agent, or Firm*—Silverman, Cass & Singer, Ltd.

[57] ABSTRACT

A detachable anchoring device for a seat assembly which is attached through a support member to a substantially planar sled support base having a quick release connector assembly capable of releasably connecting the planar base in a desired position with respect to a fixed station. The quick release connector assembly includes a bracket connected to a machine or service counter and a connecting member for releasably connecting a first portion of the planar base to the bracket, the planar base remaining substantially in contact with a portion of a planar floor surface during connecting to the bracket. Locking means may be included to prevent inadvertent disengagement of the anchoring device.

17 Claims, 2 Drawing Sheets 10
12
14
16
18
20
22
24
26
28
30
32
34
36
38
40
42
44
45
46
48
50
52
54
A
B
6

Fig. 9
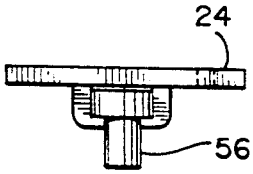
Fig. 8
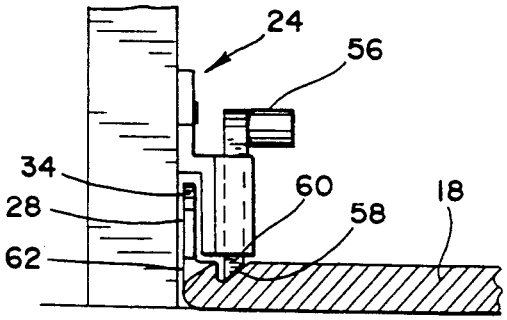
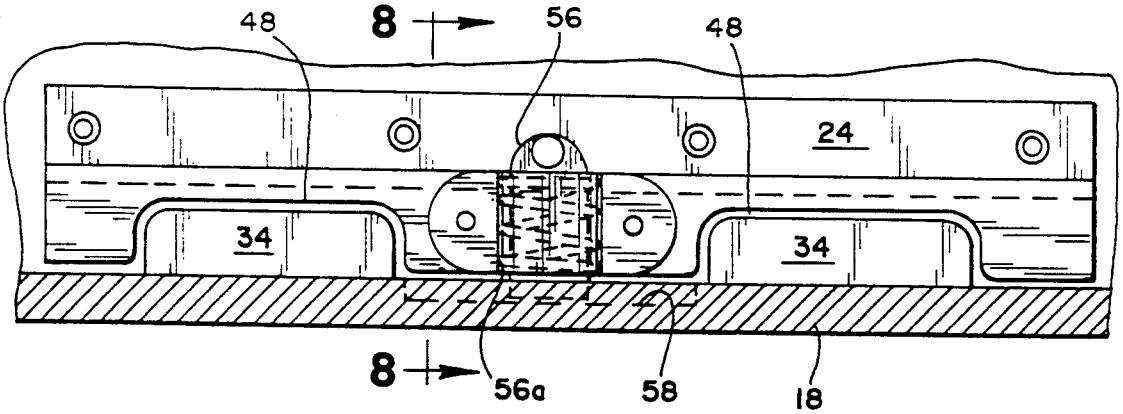
Fig. 7

DETACHABLE ANCHORING DEVICE FOR A SEAT ASSEMBLY

FIELD OF THE INVENTION

This invention relates generally to detachable anchoring means for selectively positioning a seat assembly, such as a stool or chair, relative to a fixed station, such as a machine or service counter. More particularly, the anchoring means embodying the invention includes a novel quick release connector assembly for the support base or sled on which the seat assembly is supported or mounted relative to the fixed station.

BACKGROUND OF THE INVENTION

Prior art devices which utilize such detachable anchoring devices for a seat assembly are exemplified in U.S. Pat. Nos. 4,560,200 and 4,480,343. In U.S. Pat. No. 4,480,343, the seating assembly comprises a chair or stool 11 which includes a seat 15 secured to the upper end of a standard or post 12 and the post 12 is secured upstanding on a support base or sled 13. The support base 13 includes an upturned edge forming a quick release fitting 19 having a registration portion 21 which is inserted within a U-shaped channel member 22 secured to a machine base 23. In order to effect removal and insertion of the registration portion 21 within the channel 22, the chair 11 and the end of the support base 13 opposite the quick release fitting 19 must be lifted vertically approximately two feet (60.96 cm) off of the floor to allow flexing of the U-shaped channel member 22 and clearance of the registration portion 21 from within the U-shaped channel member 22.

A problem encountered with this type of quick release fitting is that the lifting, disengagement and repositioning of the chair and sled base can be difficult, especially since these members typically are designed for durability and are of substantial weight. Furthermore, the channel member can become overflexed or bent during attachment or detachment of the chair as well as during normal use of the chair. These chairs also can be subjected to unintentional disengagement during normal use which can cause damage to surrounding equipment and serious injury to a user.

The present invention provides an anchoring structure for a seat assembly having a novel quick release connector assembly for a sled base of the seat assembly which is operable without the need for vertical lifting of the seat assembly or sled base and which is not subject to damage or unintentional disengagement during normal use.

SUMMARY OF THE INVENTION

A detachable anchoring device for a seat assembly attached through a support member to a substantially planar support base or sled including a quick release connector assembly for releasably connecting the planar base in a desired position with respect to a fixed station. The quick release connector assembly includes a cooperating bracket connected to a machine or service counter and a connecting member for releasably connecting a first portion of the support base or sled to the bracket, the base or sled remaining substantially in face-to-face contact with the floor while engaging the connecting member to the bracket.

The cooperating bracket and connecting member which provide the operative means of the detachable anchoring device embodying the invention may include a releasable locking member for preventing inadvertent disengagement of the operative means of the device.

BRIEF DESCRIPTION OF THE DRAWINGS

FIG. 7 is a front elevational view of another embodiment of the invention having a slide bolt member;

FIG. 8 is a cross-sectional view taken generally along the line 8—8 of FIG. 7 illustrating the engagement of the slide bolt with the sled base; and FIG. 9 is a top plan view of the slide bolt illustrated in FIG. 7.

DESCRIPTION OF THE PREFERRED EMBODIMENTS

Figures 1, 2, 3, 4, 5, 6:
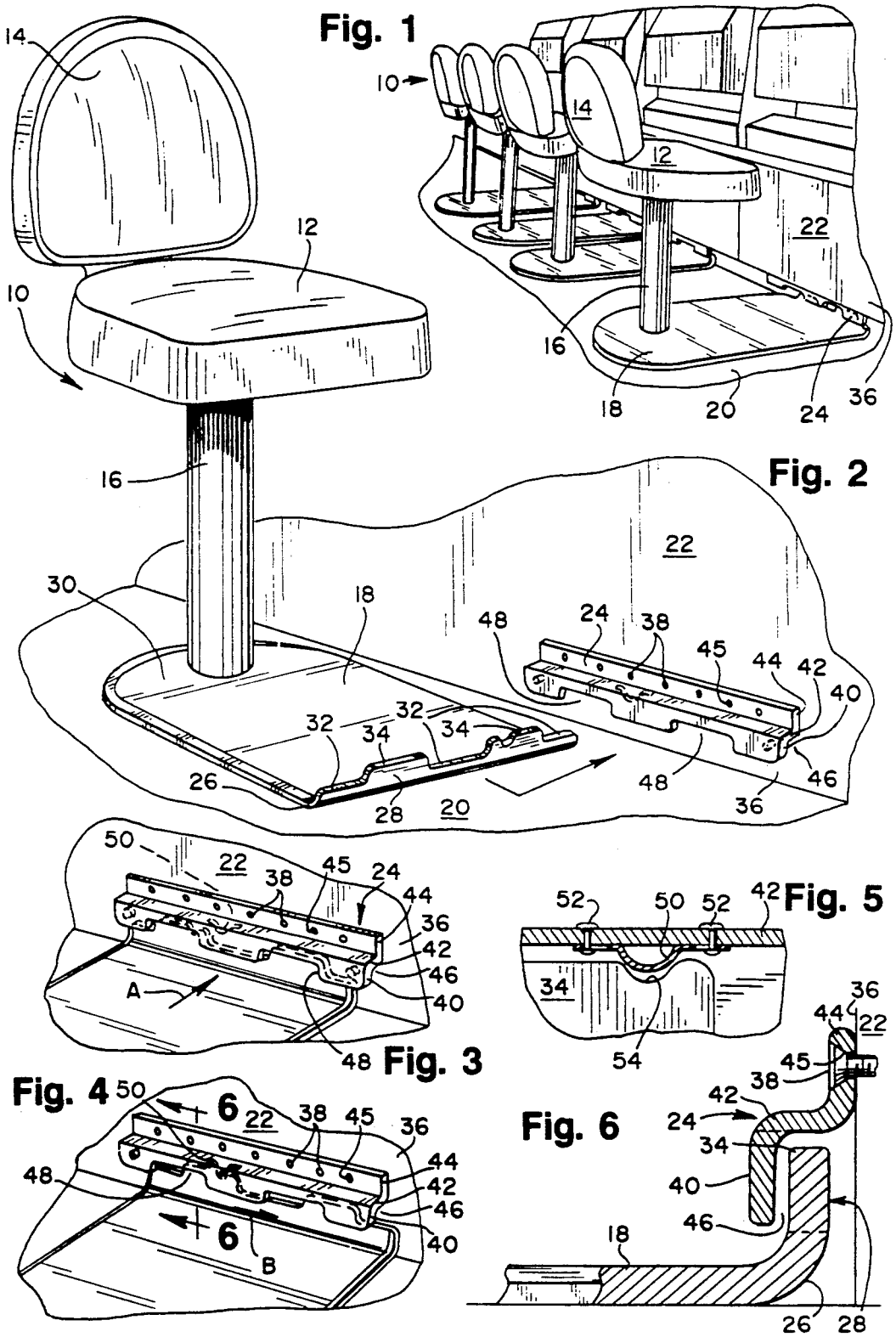
FIG. 1 is a partial perspective view of a plurality of chairs positioned in front of a machine, such as a casino game machine, each chair having a sled base adapted for use with the quick release connector assembly of the present invention.
FIG. 2 is an enlarged perspective view of a chair and sled base removed from the gaming machine illustrating the upturned edge of the sled base and the bracket member of the invention in detail.
FIG. 3 is an enlarged partial perspective view of the sled base initially being inserted within the bracket member of the invention.
FIG. 4 is an enlarged partial perspective view, similar to FIG. 3, illustrating the movement of the sled base within the channel member of the bracket to its final position.
FIG. 5 is an enlarged partial cross-sectional view of the channel member illustrating the spring engagement member secured therein.
FIG. 6 is an enlarged partial cross-sectional view of the assembly taken generally along the line 6—6 of FIG. 4 illustrating the positioning of the upturned edge of the sled base within the channel member.

Referring to FIGS. 1 and 2, a chair or counter stool is designated generally by the reference numeral 10. The chair 10 preferably includes a seat portion 12 and a back portion 14 which may or may not be padded. A pedestal, post or column type support member 16 also is included having a substantially planar sled support base 18 which is positioned overlying a portion of a substantially planar floor surface 20. The floor 20 can be constructed from any type of material and can include carpeting, if desired.

The chair 10 preferably is utilized in conjunction with a casino gaming machine 22, such as a slot machine or the like, and is releasably connected thereto through a detachable anchoring device having a quick release connector assembly defined by the sled base 18 and a bracket 24 as will be described in detail below. Alternatively, the anchoring device can be utilized to connect the chair 10 to a member other than the gaming machine 22 such as a service counter, wall, base board or any other member substantially upstanding with respect to the floor 20 and can be formed to connect the chair 10 directly to the floor 20, if desired.

The sled base 18 preferably is constructed of a flat sheet of metal or the like having a predetermined thickness and weight and having a substantially oval shape with one end 26 squared off and formed with an upturned edge 28. The particular material and shape of the sled base 18 can vary. The support member 16 is formed as a single pedestal or post member and is connected to the sled base 18 proximate an oval end 30 opposite the squared off end 26.

The upturned edge 28 includes a plurality of cut out portions 32 along its outer edge forming upstanding tabs 34 therebetween. In the preferred embodiment, three cut outs 32 and two tabs 34 are utilized, but the number and size of the cut outs 32 and tabs 34 can vary.

As illustrated in FIGS. 2–4 and 6, the bracket 24 preferably is connected to a front bottom surface 36 of the gaming machine 22 such as by fasteners 38. The bracket 24 generally is of a Z-shaped cross-sectional configuration having a first leg 40, second leg 42 and third leg 44 where the second leg 42 connects and substantially is perpendicular to the first and third legs 40 and 44, respectively. The third leg 44 includes apertures 45 through which the fasteners 38 are inserted to enable fastening of the bracket 24 to the gaming machine 22.

When the bracket 24 is connected to the gaming machine 22, a channel 46 is formed between the first leg 40, second leg 42, and the front bottom surface 36 of the gaming machine 22. The channel 46 preferably faces downwardly toward the floor 20 and accepts the upturned edge 28 of the sled base 18. It is to be noted that the bracket 24 can be formed in a variety of shapes and can be designed to be connected directly to the floor 20 (not illustrated) so long as it functions as described.

As FIGS. 2–4 illustrate, the first leg 40 includes cut out slot portions 48 through which the tabs 34 of the upturned edge 28 of the sled base 18 are inserted to seat within the channel 46 during fastening. Although two slots 48 are illustrated, the number and size of the slots 48 can vary so long as the tabs 34 can be inserted therethrough as described.

As FIGS. 3–5 illustrate, to assist in retaining the tabs 34 within the channel 46, a flexible spring member 50 is secured within the channel 46, and preferably is secured to the second leg 42. The spring member 50 can be made from resilient metal or the like and, as FIG. 5 illustrates, can be secured to the second leg 42 with fasteners 52, such as rivets, screws or similar fasteners. More than one spring member 50 can be utilized if desired. Additionally, to assist in securing the upturned edge 28 within the channel 46 and provide a positive indication that the upturned edge 28 is in a final position, the upturned edge 28 preferably includes a recessed portion 54 into which the spring member 50 extends.

To connect the sled base 18 to the bracket 24, the sled base 18 initially is moved along the floor 20 toward the bracket 24 which is connected to the gaming machine 22 and the tabs 34 first are aligned with the slots 48. The sled base 18 then is moved forward in the direction indicated by arrow "A" in FIG. 3 toward the gaming machine 22 so the tabs 34 extend through the slots 48 into the channel 46. The sled base 18 then is moved along the length of the channel 46 in the direction indicated by arrow "B" in FIG. 4 until the spring member 50 is seated within the recessed portion 54 of the upturned edge 28 of the sled base 18 to resiliently retain the sled base 18 within the bracket 24. In order to remove the sled base 18 from the bracket 24, the above steps substantially are reversed.

It is to be understood that, although the spring member 50 is illustrated in FIGS. 2–4 as being positioned proximate the right side of the slot 48, the spring member 50 also can be positioned proximate the left side of the slot 48 so that the sled base 18 is moved in the channel 46 opposite the direction of arrow "B" in FIG. 4. Preferably, the sled base 18 is moved within the channel 46 a distance of approximately two inches (5.08 cm), which can vary.

FIGS. 7–9 illustrate another embodiment of the invention where common elements are referred to by the same reference numerals. In this embodiment, to further secure the sled base 18 within the bracket 24, a sliding bolt 56 can be connected to the bracket 24 for engagement with a corresponding groove 58 formed in the sled base 18 proximate the upturned edge 28.

Preferably, the sliding bolt 56 is positioned between the slots 48 and the groove 58 is positioned between the tabs 34. As FIG. 8 illustrates, to assist in engagement as will be explained below, the groove 58 and engagement end 60 of the sliding bolt 56 can be provided with corresponding tapered surfaces and the front edge 62 of the sled base 18 can be rounded off.

In operation, with the sliding bolt 56 positioned in an upward unengaged position with respect to FIGS. 7 and 8 (not illustrated , the tabs 34 are positioned within the channel 46 as in FIG. 3 of the embodiment of FIGS. 1–6. The sliding bolt 56 then is moved downwardly to engage within the groove 58 and releasably maintain the sled base 18 in engagement with the bracket 24. In this embodiment, the tabs 34 preferably are moved within the channel 46 and a spring member 50, with or without a recessed portion 54, can be utilized.

Alternatively, due to the rounded front edge 62, mating tapered groove 58 of the base 18, and engagement end 60 of the sliding bolt 56, the sled base 18 can be inserted within the bracket 24 without the need to raise the sliding bolt 56 upward. In this situation, the rounded front edge 62 of the base 18 raises the sliding bolt 56 upon insertion of the tabs 34 of the sled base 18 within the channel 46. Upon continued movement of the tabs 34 into the channel 46, the sliding bolt 56 engages within the groove 58 and restricts outward movement of the sled base 18. It is to be noted that the tabs 34 preferably are moved within the channel 46, a spring member 50 with or without a recessed portion 54 can be included and the sliding bolt 56 can be spring loaded, if desired.

The simplicity and economy of the detachable anchoring device and chair 10 as well as its installation readily can be appreciated. Simple tooling and parts are involved. Minor variations in dimensions and configuration of component parts of the invention may occur to the skilled artisan without departing from the scope of the invention as set forth in the appended claims.

I claim:

1. In a detachable anchoring device for a seat assembly vertically oriented on a substantially planar support base, a quick release connector assembly for releasably connecting the planar base in a desired position with respect to a fixed station such as a machine or the like comprising:

bracket means connected to said station, said bracket means including a flange having at least first and second legs, said second leg extending outwardly from said machine or service counter and having a predetermined length, said first leg connected perpendicular to said second leg to form a channel facing a planar floor surface supporting said station; and connecting means for releasably connecting a first portion of said planar base within said channel for connection to said bracket means, said entire planar base remaining substantially in contact with a portion of the planar floor surface supporting said station during connection of said connecting means to said bracket means.

2. The device as defined in claim 1 wherein said first portion of said planar base includes an upturned edge for engagement within said channel.

3. The device as defined in claim 2 wherein said first leg includes at least one cut out portion along its length, said first portion of said planar base including at least one upturned edge portion forming a tab for insertion through said cut out portion and into said channel so that said planar base can be slid along said planar surface and connected to said bracket means by inserting said upturned edge tab portion through said cut out and into said channel.

4. The device as defined in claim 2 including spring means within said channel for providing resilient retaining of said upturned edge within said channel.

5. The device as defined in claim 4 wherein said upturned edge includes a recess of seating of said spring member therein.

6. The device as defined in claim 2 wherein said bracket means include a slide bolt for releasable engagement within a corresponding groove of said planar base.

7. The device as defined in claim 6 wherein said slide bolt is spring loaded.

8. A seat assembly adapted to be releasably installed in a selective location relative to a fixed station ,such as a machine or the like, said assembly comprising:

a. a seat and a standard, said standard being oriented vertically and said seat being supported on the upper end of said standard;

b. a planar sled or support base having said standard secured thereon;

c. a detachable anchoring assembly for installing the seat assembly in said selective location including cooperating bracket and connecting means for releasably connecting said seat assembly in said location;

d. said bracket means adapted to be installed on said station;

e. said connecting means being secured at an extremity of said base; and f. said bracket means and connecting means having cooperating tongue and grove formations adapted to be releasably engaged and disengaged by a linear displacement movement one relative to the other.

9. The seat assembly as defined in claim 8 in which said tongue formations are formed on the connecting means and said groove formations are formed on the bracket means.

10. The seat assembly as defined in claim 9 in which said bracket means include a track for receiving said tongue formations for sliding movement therein through said groove formations.

11. The seat assembly as defined in claim 9 including releasable locking means for preventing inadvertent disengagement of said tongue and groove formations.

12. The seat assembly as defined in claim 9 in which said tongue formations are spaced apart and integral with the base, and said groove formations are spaced apart in a complementary relationship for receiving said tongue formations thereinto and permit a linear sliding movement one relative the other for releasably securing said seat assembly in said selective location.

13. The seat assembly as defined in claim 12 which includes releasable locking means for preventing inadvertent sliding movement of said formations relative to the other whereby to prevent disengagement of said formations.

14. A seat assembly having a detachable anchoring device including a quick release connector assembly for releasably securing a substantially planar sled support base of the chair at a desired position with respect to a fixed station, the quick release connector assembly comprising:

an upturned edge positioned on a first portion of said planar base;

bracket means connected to at least one of a machine or service counter, said bracket means including a flange having first, second and third leg members, said third leg member being connected to said machine or service counter, said second leg member extending outwardly from said third leg and said first leg member extending substantially perpendicular from said second leg member toward said planar floor surface to form a channel facing said planar floor surface, said first leg member having at least one cut out portion therethrough and said channel capable of accepting said upturned edge portion of said planar base therein; and spring means within said channel for providing resilient retaining of said upturned edge portion within said channel so that said planar base can be slid along said planar surface in a first direction substantially perpendicular to said channel, said upturned edge portion can be inserted through said cut out and then moved along the length of said channel for engagement with said spring means.

15. The seat assembly as defined in claim 14 wherein said upturned edge includes a recess for seating of said spring member therein.

16. The seat assembly as defined in claim 14 wherein said bracket means include a slide bolt for releasable engagement within a corresponding groove of said planar base for releasably locking said means against inadvertent disengagement one from the other.

17. The seat assembly as defined in claim 16 wherein said slide bolt is spring loaded.

* * * * *

UNITED STATES PATENT AND TRADEMARK OFFICE

CERTIFICATE OF CORRECTION

PATENT NO. : 5,102,192

DATED : April 7, 1992

INVENTOR(S) : Peter Barile, Sr.

It is certified that error appears in the above-identified patent and that said Letters Patent is hereby corrected as shown below:

Column 4, line 41, after "loaded" insert

--with a spring 56a (illustrated in FIG. 7.)--.

Column 5, line 20, after "recess" delete "of" and insert --for--.

Signed and Sealed this

Sixth Day of July, 1993

*Attest:*

*Attesting Officer*

Michael K. Kirk

MICHAEL K. KIRK

*Acting Commissioner of Patents and Trademarks*